US006475099B1

(12) United States Patent
Sumitomo et al.

(10) Patent No.: US 6,475,099 B1
(45) Date of Patent: Nov. 5, 2002

(54) GOLF CLUB HEAD

(75) Inventors: Norio Sumitomo; Masaya Tsunoda, both of Akashi (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/339,223

(22) Filed: Jun. 24, 1999

(30) Foreign Application Priority Data

Jun. 26, 1998 (JP) ..... 10-180561

(51) Int. Cl.[7] ..... A63B 53/00; A63B 55/02; A63B 53/04; A63B 53/06

(52) U.S. Cl. ..... 473/290; 473/291; 473/331; 473/324; 473/330; 29/407.01

(58) Field of Search ..... 473/324, 330, 473/331, 342, 347, 348, 349, 290, 29; 273/77 R, 77 A, 167 R, 175, 167 J; 29/407.01

(56) References Cited

U.S. PATENT DOCUMENTS 4,754,971 A * 7/1988 Kobayashi ..... 273/77
4,768,787 A * 9/1988 Shira ..... 273/175
4,902,016 A * 2/1990 Boone ..... 273/175
5,766,087 A * 6/1998 Kawamatsu ..... 473/290
5,890,971 A * 4/1999 Shiraishi ..... 473/291

* cited by examiner

*Primary Examiner*—Paul T. Sewell
*Assistant Examiner*—Sneh Varma
(74) *Attorney, Agent, or Firm*—Birch, Stewart, Kolasch & Birch, LLP

(57) ABSTRACT

A golf club head comprises a ball striking face having a loft angle of from 6 to 30 degrees, and has a depth of the gravity center of not less than 18 mm, wherein the ball striking face is provided with a high frictional region of which maximum static friction coefficient at a high load of 400 kgf is not less than 0.35 whereby back spin of a hit ball is decreased and the flying distance of the ball can be increased. The high-load friction coefficient can be obtained by means of surface treatment, for example, etching, blasting, polishing, spraying a metal compound, vapor deposition of a metal compound and the like.

13 Claims, 5 Drawing Sheets

GOLF CLUB HEAD

BACKGROUND OF THE INVENTION

1. Field of the Invention

The present invention relates to a golf club head, of which loft angle is 6 to 30 degrees and depth of the center of gravity is not less than 18 mm, and which has a ball striking face increased in the coefficient of friction at high load so as to decrease the back spin of a hit ball and thereby to increase the flying distance.

2. Description of the Related Art

For golf clubs such as driver, fairway wood or similar metal wood (hereinafter genericly called wood club) having a club head of which center of gravity is relatively deep, it is particularly important to gain a long flying distance.

It is known that the flying distance performance of a golf club depends greatly on the depth of the center of gravity and back spin of a hit ball, and the greater the gravity center depth, the higher the flying height.

In case of iron clubs of which gravity center depth is small, it is difficult to make the flying height higher in comparison with the wood clubs. Therefore, when golfers whose golf club head speed is relatively slow use long iron clubs or the like of which loft angle is less than about 30 degrees, the back spin is usually increased to obtain a sufficient trajectory height and thereby to increase the flying distance. On the other hand, golfers whose golf club head speed is fast had better decrease the back spin rate in order to suppress the trajectory height so as to obtain a maximum flying distance.

In case of the wood clubs of which gravity center depth is more than about 18 mm, a sufficient elevation angle can be obtained when striking a ball even if the loft angle is smaller than about 30 degrees. Therefore, the flying distance may be increased by decreasing the back spin.

General amateur golfers are however, liable to give an excessive back spin to a golf ball and fail to increase the flying distance. Therefore, it is necessary for the wood clubs to decrease back spin in order to obtain a longer flying distance.

In the laid-open Japanese Patent application No. 61-272067, in order to decrease back spin, the coefficient of friction of the ball striking face is decreased. It seems to be an effective method. Actually, however, in case of the wood clubs, the back spin is not decreased, and thus there is no effect on increasing the flying distance.

In the circumstances, the present inventors studied back spin of a golf ball hit by the wood clubs and discovered that the back spin is closely related with the maximum static friction coefficient at a high load of 400 kgf of the ball striking face, and that, in case of the wood clubs, back spin is decreased when the coefficient of friction becomes larger, in contrast to the conventional teaching.

A perfect explanation of this reason requires a further detailed analysis of complicated deformation behavior of a golf ball at the time of impact, but one factor was estimated to be the effect of internal spin (distortional vibration) of a core of the ball (B) occurring in a moment when struck by the ball striking face 4 of the club hread.

FIGS. 7(*a*) to 7(*d*) show struck state of a ball B in time sequence. And FIG. 8 is a graph showing the relation between the shearing force between the core B1 (position P1) and cover B2 (position P2) of the ball B, and the time elapsed from the impact.

As shown in FIG. 7(*a*), as the hit ball (B) is deformed, it contacts with the ball striking face 4 in a relatively wide area. The ball (B) receives a frictional force (M) in a direction along the ball striking face 4 as well as a vertical force in a normal direction to the ball striking face 4.

Hitherto, only the frictional force M was taken into consideration, and it was believed that the back spin of a ball (B) would increase as the frictional force (M) was larger.

SUMMARY OF THE INVENTION

The present inventors however discovered that as shown in FIG. 7(*b*), the cover B2 of a ball (B) is pulled in the direction of frictional force (M), and a distortion occurs between the cover B2 (position P2) and the core B1 (position P1), and a shearing force is produced therebetween.

Such distorted state returns to the original state as the deformed ball (B) starts to restore its original shape. During this restoring process, however, a shearing force in the reverse direction to that of the frictional force (M) occurs between the core B1 and the cover B2. And after the positions P1 and P2 return to the normal state as shown in FIG. 7(*c*), the returning motion continues until the positions P1 and P2 are reversed as shown in FIG. 7(*d*). In this state, the ball is launched. Thus, the core B1 in the hit ball (B) has an internal spin which is reverse to the back spin, and the back spin becomes lower when the internal spin is larger. The effect of such internal spin on reducing the back spin is particularly notable in the wood clubs having a loft angle of not more than 30 degrees.

It is therefore, an object of the present invention to provide a golf club head in which the ball striking face is increased in the high-load friction coefficient to decrease the back spin and thereby to increase the flying distance.

According to the present invention, a golf club head comprises a ball striking face having a loft angle of from 6 to 30 degrees, and has a depth of the gravity center of not less than 18 mm, wherein the ball striking face is provided with a high frictional region of which maximum static friction coefficient at a high load of 400 kgf is not less than 0.35.

Preferably, the friction coefficient is not less than 0.40.

DESCRIPTION OF THE PREFERRED EMBODIMENT

An embodiment of the present invention is described in detail in conjunction with the accompanying drawings.

Figure 2:
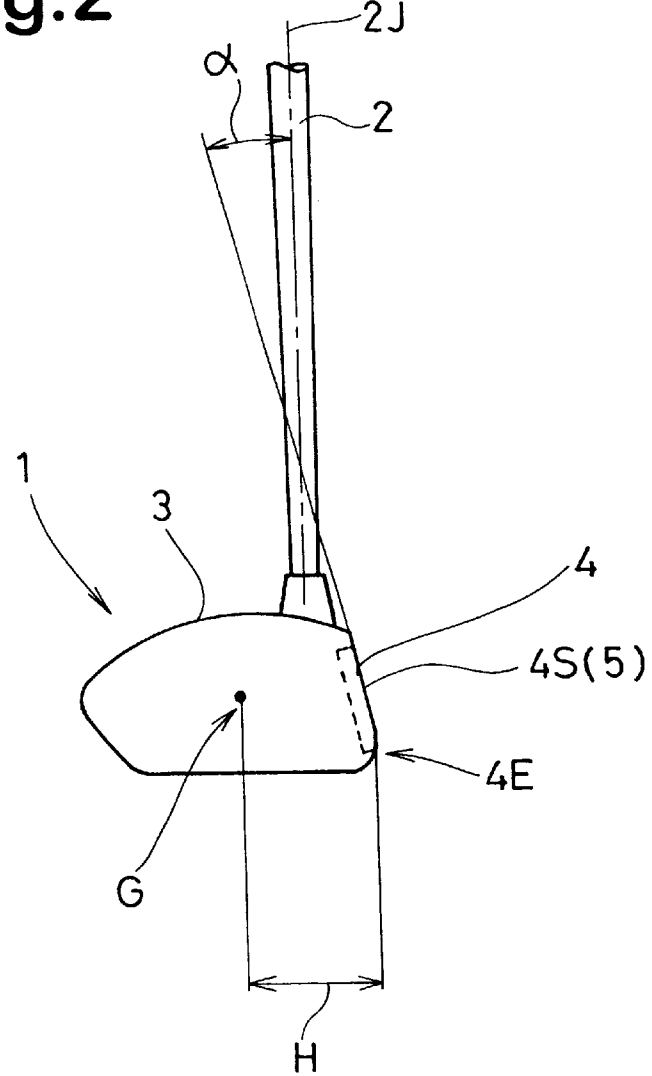
FIG. 2 is a side view thereof.
Figure 1:
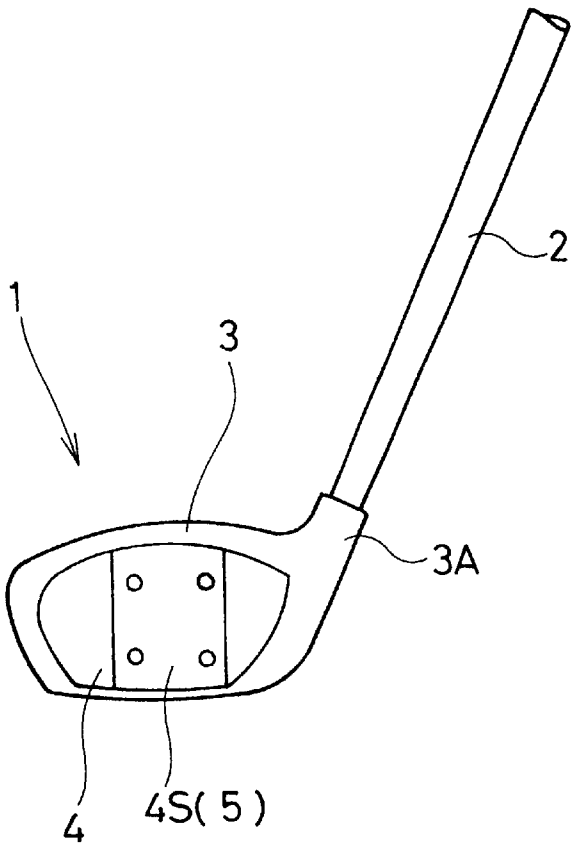
FIG. 1 is a front view showing an embodiment of the invention.

In FIGS. 1 and 2, a golf club head 1 comprises a main body 3 having a front face as a ball striking face 4, and a neck 3A to which a shaft 2 is fixed. The ball striking face 4 has a loft angle α in a range of 6 to 30 degrees. The depth H of the gravity center G of the head is not less than 18 mm. Here, the loft angle α means the inclination angle of the ball striking face 4 with respect to the axial line 2J of the shaft 2. The depth H of the gravity center is measured from the leading edge 4E of the ball striking face 4 to the center of gravity G in the horizontal direction.

The ball striking face 4 has a high frictional region 4S at least partially. The high frictional region 4S has a high-load friction coefficient of not less than 0.35 preferably not less than 0.40. Preferably, the high-load friction coefficient is set to be not more than 0.6. The high-load friction coefficient is the maximum static friction coefficient when a load of 400 kgf acts between the surface and a ball (B).

In FIG. 1, the high frictional region 4S is formed by a face plate 5 having the high-load friction coefficient which is separate from the main body 3. The face plate 5 is disposed in a recess formed in front of the main body 3 and fixed by means of screwing, press-fitting, adhering and the like. In this example, the face plate 5 is a metallic plate which is smaller than the entire ball striking face 4, and which is centered on the sweet spot. However, it is also possible to form the face plate 5 as extending over the entire ball striking face 4. Further, it is possible to form the high frictional region 4S integrally with the main body 3.

The above-mentioned high-load friction coefficient can be obtained by means of surface treatment to the high frictional region 4S, for example, etching, blasting, polishing, spraying a metal compound, vapor deposition of a metal compound and the like.

Figure 3:
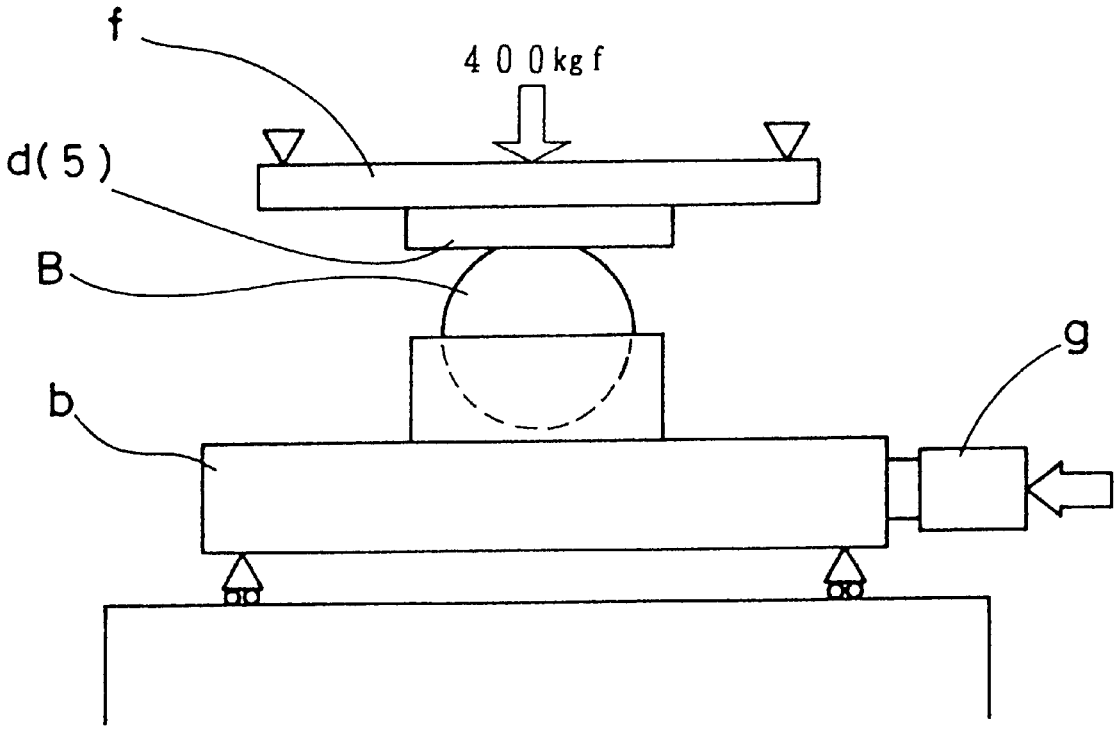
FIG. 3 is a diagram for explaining a method of measuring the high-load friction coefficient,of the ball striking face.

The above-mentioned high-load friction coefficient was measured using a Universal Testing Machine RH-30 of SHIMADZU SEISAKUSYO in Japan as follows. As shown in FIG. 3, a specimen of the high frictional region 4S (in this example, face plate 5) is fixed to a compressor head (f), and a golf ball (B) is fixed to a slide table (b), using an adapter to expose about one half thereof. The table (b) is moved in a lateral direction at 50 mm/min while applying a vertical load of 400 kg. And the lateral load applied to the table was measured for its variation with a load cell (g).

Figure 4:
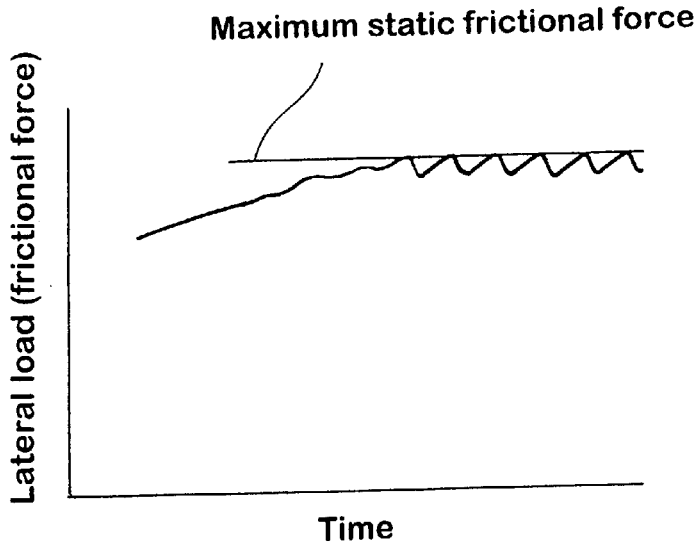
FIG. 4 is a graph showing an example of the measured lateral load (frictional force).
Figure 8:
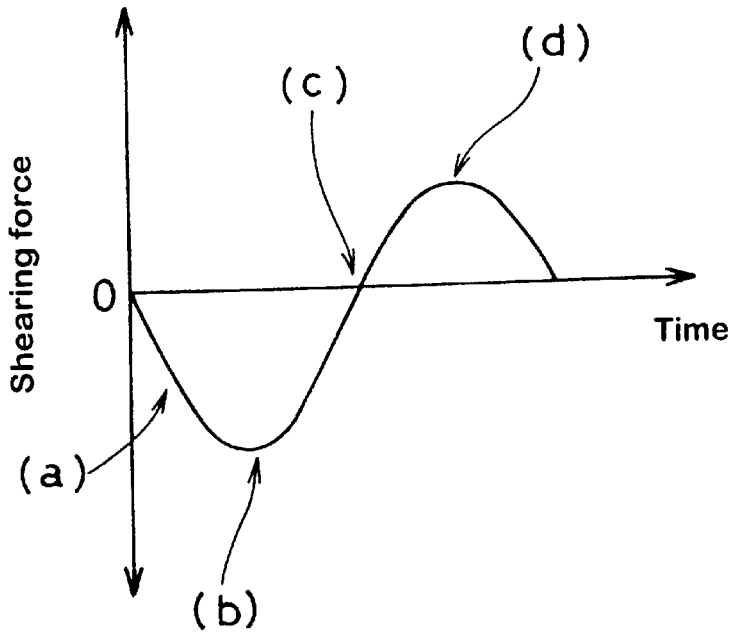
FIG. 8 is a graph showing the shearing force between the cover and core of the ball as a function of the time elapsed from impact.

In FIG. 4, an exemplified variation of the lateral force is shown. Based on the measured maximum value or the maximum static frictional force, the high-load friction coefficient was obtained as the quotient of the maximum value divided by the vertical load of 400 kgf.

Incidentally, the golf ball (B) used was a "DDH Tour Special RB" manufactured by Sumitomo Rubber Industries, Ltd. This ball (B) is a so called two-piece ball having a core made of polybutadiene rubber and an outer cover made of ionomer resin of 2.3 mm in thickness coated with urethane paint. When a load of 400 kgf was applied, the contact area of this ball (B) with the face plate was about 300 sq.mm.

Comparison Test: Golf clubs were made and tested for the back spin rate and flying distance by using a swing robot. Each club had a wood head 1 and a face plate 5 was fixed by screws as shown in FIG. 1. In respect of the shape of club head, four types of heads of ordinary wood clubs shown in Table 1 were used according to the loft angle α. The specifications of the face plates 5 and test results are shown in Table 2. In Table 2, the flying distance indicates the total yard of carry and run.

TABLE 1

| Club type | Loft angle (deg.) | Club length (in.) | Head speed (m/s) | corresponding Wood club |
|---|---|---|---|---|
| 1 | 6 | 45 | 40 | No. 1 Wood |
| 2 | 15 | 43 | 38 | No. 3 Wood |
| 3 | 21 | 41.5 | 36.5 | No. 5 Wood |
| 4 | 30 | 40.5 | 35.5 | No. 7 Wood |

TABLE 2

| | Face material | Loft angle (deg.) | Gravity center depth (mm) | Surface treatment | High-load friction coefficient | Spin rate (rpm) | Flying distance (yards) |
|---|---|---|---|---|---|---|---|
| Prior art | | | | | | | |
| 1 | SUS630 | 6 | 18 | Painting | 0.24 | 2667 | 195 |
| 2 | SUS630 | 15 | 19 | Painting | 0.24 | 3590 | 187 |
| 3 | SUS630 | 21 | 21 | Painting | 0.24 | 3926 | 175 |
| 4 | SUS630 | 30 | 25 | Painting | 0.24 | 5328 | 165 |
| 5 | SUS630 | 30 | 25 | Polishing only | 0.31 | 4950 | 170 |
| 6 | 5U5630 | 30 | 25 | DLC | 0.15 | 5485 | 159 |
| 7 | SUS630 | 30 | 25 | TiAlN | 0.1 | 5601 | 157 |
| 8 | SUS630 | 30 | 25 | Teflon plating | 0.13 | 5589 | 158 |

TABLE 2-continued

| | Face material | Loft angle (deg.) | Gravity center depth (mm) | Surface treatment | High-load friction coefficient | Spin rate (rpm) | Flying distance (yards) |
|---|---|---|---|---|---|---|---|
| 9 | 6-4Ti | 6 | 18 | Painting | 0.28 | 2634 | 198 |
| 10 | 6-4Ti | 30 | 25 | Painting | 0.28 | 5132 | 168 |
| Example | | | | | | | |
| 1 | SUS630 | 6 | 18 | Etching | 0.5 | 2396 | 219 |
| 2 | SU5630 | 15 | 19 | Etching | 0.5 | 3209 | 199 |
| 3 | SU5630 | 21 | 21 | Etching | 0.5 | 3269 | 188 |
| 4 | SUS630 | 30 | 25 | Etching | 0.5 | 4394 | 180 |
| 5 | SUS630 | 6 | 25 | TiN | 0.37 | 2513 | 207 |
| 6 | SUS630 | 6 | 25 | WC spray | 0.41 | 2451 | 212 |
| 7 | 5US630 | 30 | 25 | Blasting | 0.4 | 4626 | 177 |
| 8 | SU5630 | 30 | 25 | Rough polishing | 0.45 | 4447 | 178 |

Surface treatment:
Painting: Urethane painting conventionally used for club head.
Polishing only: Polishing by No. 320 sandpaper
Rough polishing: Polishing by No. 80 sandpaper
DLC, TiN, and TiAlN: Vapor deposition of DLC (diamond-like carbon), TiN (titanium nitride), and TiAlN (titanium aluminum nitride), respectively.

As apparent from comparison of example 1 with prior art 1, example 2 with prior art 2, example 3 with prior art 3, example 4 with prior art 4 and so on, the example clubs having the higher frictional coefficient displayed a lower back spin rate and longer flying distance.

Contrary to the conventional knowledge, in the prior art clubs 4–8 having the same loft angle of 30 degrees, as the friction coefficient becomes lower, the back spin rate becomes higher.

Figure 5:
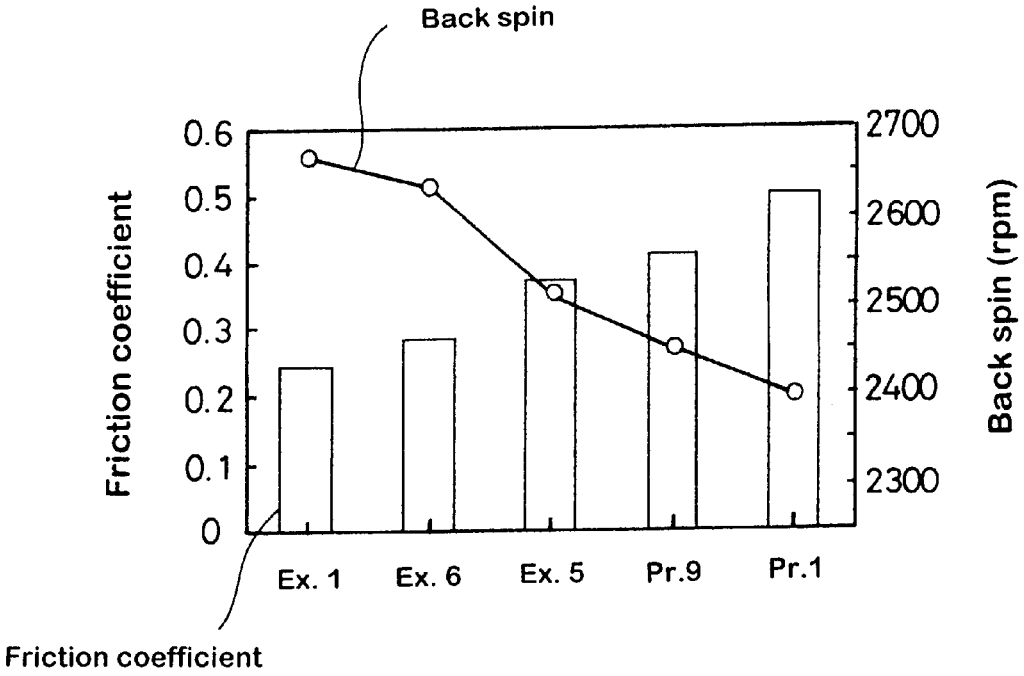
FIG. 5 is a graph showing a relation between the high-load friction coefficient and back spin rate at a loft angle of 6 degrees.
Figure 6:
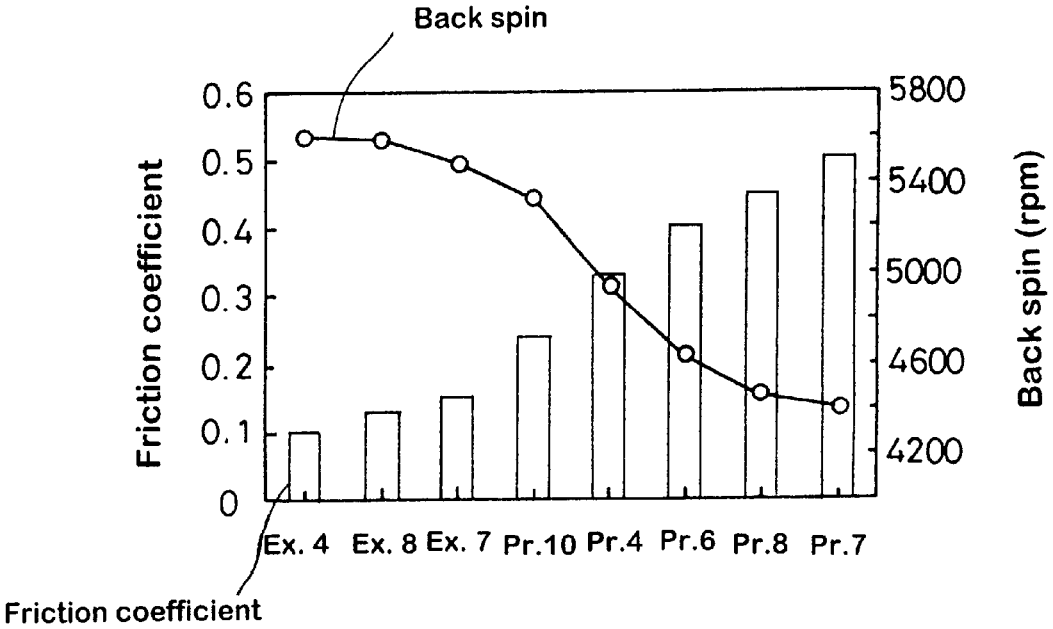
FIG. 6 is a graph showing a relation between the high-load friction coefficient and back spin rate at a loft angle of 30 degrees.
Figure 7A:
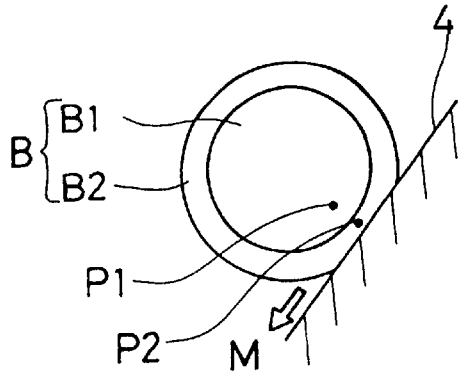
FIGS. 7(*a*) to 7(*d*) are diagrams for explaining the internal spin of a hit ball.
Figure 7B:
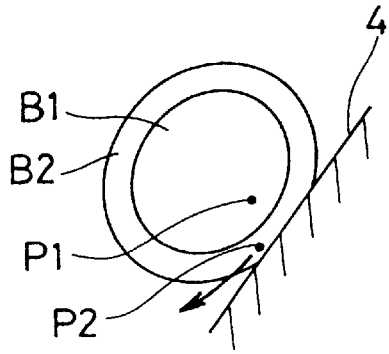
Figure 7C:
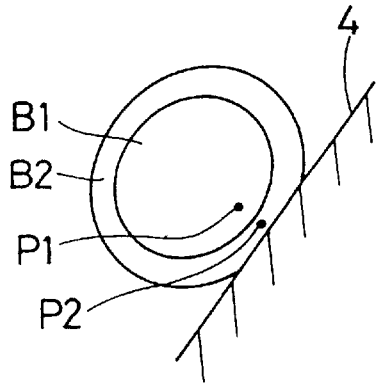
Figure 7D:
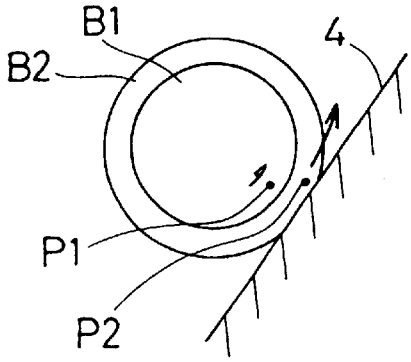

The measured back spin rate are also shown in FIG. 5 (loft angle 6 deg.) and FIG. 6 (loft angle 30 deg.). These figures apparently show that the high-load friction coefficient and back spin rate have a correlation contrary to the conventional knowledge.

As described above, in the golf club head according to the present invention, as the ball striking face is increased in the high-load friction coefficient, the back spin rate of hit ball can be decreased, and as a result, the flying distance can be increased.

The present invention suitably applied to golf club heads of driver, fairway wood, metal-wood and the like.

What is claimed is:

1. A golf club head comprising a ball striking face having a loft angle of from 6 to 30 degrees, and having a depth of the gravity center of not less than 18 mm, said ball striking face provided with a region adjusted to decrease spin of a hit golf ball such that a maximum static friction coefficient of said region is set in a range of not less than 0.35 but not more than 0.6, said maximum static friction coefficient being the quotient of a maximum force required to move a golf ball relatively to the ball striking face at a speed of 50 mm/minute in a direction parallel to the ball striking face when the golf ball is relatively pressed against the ball striking face at a load of 400 kgf normally to the ball striking face, divided by the load of 400 kgf, wherein said golf ball is a two-piece ball having a core made of polybutadiene rubber and an outer cover made of ionomer resin of 2.3 mm in thickness coated with urethane paint, and the golf ball has a contact area of substantially 300 sq.mm with the ball striking face when the load of 400 kgf is applied.

2. The golf club head according to claim 1, wherein the friction coefficient is not lees than 0.40 but not more than 0.6 to impart less spin to a hit golf ball.

3. The golf club head according to claim 1, wherein said high frictional region is provided with said friction coefficient by a surface treatment by etching.

4. The golf club head according to claim 1, wherein said high frictional region is provided with said friction coefficient by a surface treatment by blasting.

5. The golf club head according to claim 1, wherein said high frictional region is provided with said friction coefficient by a surface treatment by polishing.

6. The golf club head according to claim 1, wherein said high frictional region is provided with said friction coefficient by a surface treatment by spraying a metal compound.

7. The golf club head according to claim 1, wherein said high frictional region is provided with said friction coefficient by a surface treatment by vapor deposition of a metal compound.

8. The golf club head according to claim 2, wherein said high frictional region is provided with said friction coefficient by a surface treatment by etching.

9. The golf club head according to claim 2, wherein said high frictional region is provided with said friction coefficient by a surface treatment by blasting.

10. The golf club head according to claim 2, wherein said high frictional region is provided with said friction coefficient by a surface treatment by polishing.

11. The golf club head according to claim 2, wherein said high frictional region is provided with said friction coefficient by a surface treatment by spraying a metal compound.

12. The golf club head according to claim 2, wherein said high frictional region is provided with said friction coefficient by a surface treatment by vapor deposition of a metal compound.

13. A method of making a golf club head, said golf club head comprising a ball striking face having a loft angle of from 6 to 30 degrees, and having a depth of the gravity center of not less than 18 mm, said method comprising providing said ball striking face with a region for decreasing spin of a hit golf ball by specifically limiting a maximum static friction coefficient of said region, said maximum static friction coefficient being the quotient of a maximum force required to move a golf ball relatively to the ball striking face at a speed of 50 mm/minute in a direction parallel to the ball striking face while the golf ball is relatively pressed against the ball striking face at a load of 400 kgf normally to the ball striking face, divided by the load of 400 kgf, wherein said golf ball is a two-piece ball having a core made of polybutadiene rubber and an outer cover made of ionomer resin of 2.3 mm in thickness coated with urethane paint, and the golf ball has a contact area of substantially 300 sq.mm with the ball striking face when the load of 400 kgf is applied, and determining the maximum static friction coefficient of said region within a range of not less than 0.35 but not more than 0.6.

* * * * *